US010865659B2

(12) United States Patent
Lochner et al.

(10) Patent No.: US 10,865,659 B2
(45) Date of Patent: Dec. 15, 2020

(54) APPARATUS FOR ORIENTING A GUIDE VANE SUPPORT RELATIVE TO A TURBINE CASING

(71) Applicant: Siemens Aktiengesellschaft, Munich (DE)

(72) Inventors: Klaus Lochner, Markersdorf-Pfaffendorf (DE); Andreas Mucha, Pad Muskau (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 644 days.

(21) Appl. No.: 15/326,731

(22) PCT Filed: May 11, 2015

(86) PCT No.: PCT/EP2015/060303

§ 371 (c)(1),
(2) Date: Jan. 17, 2017

(87) PCT Pub. No.: WO2016/012115

PCT Pub. Date: Jan. 28, 2016

(65) Prior Publication Data

US 2017/0204745 A1 Jul. 20, 2017

(30) Foreign Application Priority Data

Jul. 25, 2014 (DE) ..... 10 2014 214 703

(51) Int. Cl.
*F01D 25/24* (2006.01)
*F01D 25/28* (2006.01)

(52) U.S. Cl.
CPC ..... *F01D 25/246* (2013.01); *F01D 25/28* (2013.01); *F05D 2230/60* (2013.01)

(58) Field of Classification Search
USPC ..... 403/43
See application file for complete search history.

(56) References Cited

U.S. PATENT DOCUMENTS 1,706,651 A * 3/1929 Casey ..... F16B 35/04 403/43
2,247,423 A * 7/1941 Webster, Jr. ..... F01D 25/246 415/126

(Continued)

FOREIGN PATENT DOCUMENTS

DE 726510 C 10/1942
DE 102008002852 A1 11/2008

(Continued)

OTHER PUBLICATIONS

DE Search Report dated Mar. 23, 2015, for DE patent application No. 102014214703.4.

(Continued)

*Primary Examiner* — Peter J Bertheaud
*Assistant Examiner* — Geoffrey S Lee

(57) ABSTRACT

An apparatus and method for orienting a guide vane carrier relative to a turbine casing. The apparatus has a guide device with a first region and a second region, wherein the first region is arranged in a recess of the guide vane carrier and the second region is arranged in a recess of the casing. The second region of the guide device has a guide channel with a first internal thread, wherein a first adjusting element with a first external thread is arranged in the guide channel. The first external thread can be screwed together with the first internal thread. The first adjusting element can be arranged in the guide channel such that, when the guide device is supported against a support surface of the recess, a force flow runs through the first adjusting element from the recess to the guide device.

10 Claims, 1 Drawing Sheet

(56) References Cited

U.S. PATENT DOCUMENTS

| | | | | |
|---|---|---|---|---|
| 2,886,090 | A * | 5/1959 | Rosan | F16B 35/005 411/109 |
| 3,461,769 | A * | 8/1969 | Brosseit | F16B 5/0233 403/408.1 |
| 3,498,727 | A * | 3/1970 | Bollinger, Jr. | B60T 8/3235 415/136 |
| 4,204,803 | A * | 5/1980 | Leger | F01D 25/246 415/209.2 |
| 5,340,258 | A * | 8/1994 | Simon | F16B 35/005 411/339 |
| 6,325,596 | B1 * | 12/2001 | Tomko | F01D 25/246 415/209.2 |
| 6,357,953 | B1 * | 3/2002 | Ballantyne | F16B 5/0233 403/365 |
| 6,547,523 | B2 * | 4/2003 | Nelligan | F01D 25/243 415/209.2 |
| 7,458,770 | B2 * | 12/2008 | Russo | F01D 3/02 415/126 |
| 7,588,386 | B2 * | 9/2009 | Kielczewski | F16B 5/0233 248/188.4 |
| 7,645,106 | B2 * | 1/2010 | Gordon | B25B 5/163 411/380 |
| 8,152,117 | B2 * | 4/2012 | Gain | F16B 5/0233 248/188.4 |
| 8,474,766 | B2 * | 7/2013 | Liu | F16B 5/0233 248/188.4 |
| 8,894,362 | B2 * | 11/2014 | Fretwell | F01D 25/246 29/407.01 |
| 9,285,067 | B2 * | 3/2016 | Hooghart | F16M 11/04 |
| 9,500,130 | B2 * | 11/2016 | Swan | F02C 7/20 |
| 9,739,177 | B2 * | 8/2017 | Schaefer | F01D 25/246 |
| 9,810,220 | B2 * | 11/2017 | Ghaisas | F16M 7/00 |
| 10,233,770 | B2 * | 3/2019 | Inagaki | F04D 17/122 |
| 10,392,973 | B2 * | 8/2019 | Honda | F01D 25/26 |
| 2003/0049123 | A1 * | 3/2003 | Nelligan | F01D 25/243 415/209.2 |
| 2006/0127169 | A1 * | 6/2006 | Dembowsky | F16B 5/0233 403/171 |
| 2006/0251514 | A1 * | 11/2006 | Burdgick | F01D 25/246 415/214.1 |
| 2007/0009342 | A1 * | 1/2007 | Figge | F16B 5/0233 411/546 |
| 2007/0119174 | A1 * | 5/2007 | Russo | F01D 3/02 60/645 |
| 2008/0056809 | A1 * | 3/2008 | Kielczewski | F16B 5/0233 403/118 |
| 2008/0286097 | A1 | 11/2008 | Chevrette et al. | |
| 2008/0317591 | A1 | 12/2008 | Golinkin et al. | |
| 2012/0162963 | A1 | 6/2012 | Hashimoto et al. | |
| 2013/0323026 | A1 * | 12/2013 | Abbott | F01D 25/246 415/128 |
| 2014/0250915 | A1 * | 9/2014 | Swan | F02C 7/20 60/796 |
| 2014/0353463 | A1 * | 12/2014 | Ghaisas | F16M 7/00 248/678 |
| 2015/0030444 | A1 * | 1/2015 | Meyer | F01D 25/246 415/214.1 |
| 2015/0063999 | A1 * | 3/2015 | Blough | F01D 9/02 415/208.1 |
| 2016/0305287 | A1 * | 10/2016 | Honda | F01D 25/246 |
| 2016/0341069 | A1 * | 11/2016 | Inagaki | F04D 17/122 |

FOREIGN PATENT DOCUMENTS

| | | | |
|---|---|---|---|
| DE | 102009012751 | A1 | 9/2010 |
| DE | 102012202468 | B3 | 7/2013 |
| JP | H10299411 | A | 11/1998 |
| JP | 2007154886 | A | 6/2007 |
| WO | 2010102950 | A1 | 9/2010 |

OTHER PUBLICATIONS

International Search Report dated Aug. 6, 2015, for PCT patent application No. PCT/EP2015/060303.

* cited by examiner

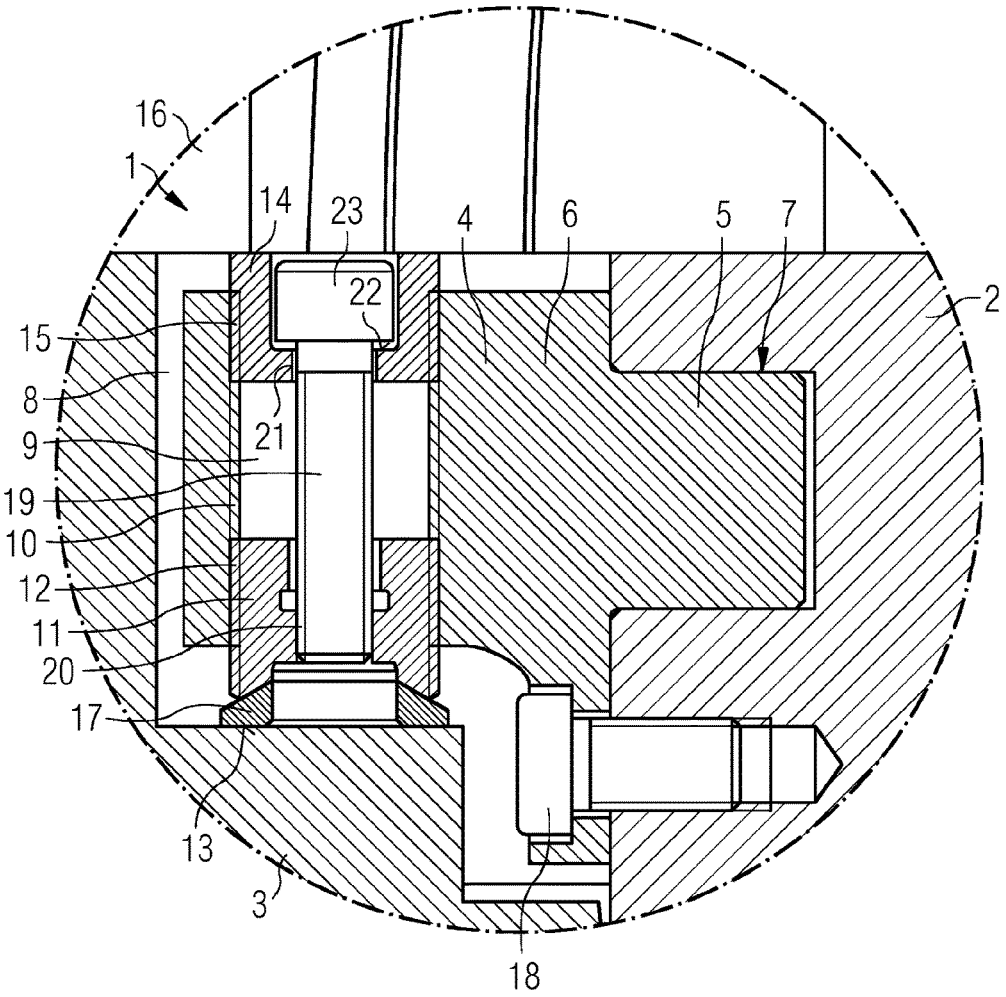
16
1
14
23
4
6
5
7
2
22
15
8
21
9
19
10
12
11
20
17
13
3
18

APPARATUS FOR ORIENTING A GUIDE VANE SUPPORT RELATIVE TO A TURBINE CASING

CROSS REFERENCE TO RELATED APPLICATIONS

This application is the US National Stage of International Application No. PCT/EP2015/060303 filed May 11, 2015, and claims the benefit thereof. The International Application claims the benefit of German Application No. DE 102014214703.4 filed Jul. 25, 2014. All of the applications are incorporated by reference herein in their entirety.

FIELD OF INVENTION

The present invention relates to an apparatus for orienting a guide vane carrier relative to a turbine casing. The invention relates in particular to such an apparatus, having a guide device with a first region and a second region, wherein the first region is arranged in a recess of the guide vane carrier and the second region is arranged in a recess of the casing. The second region of the guide device has a guide channel with a first internal thread, wherein a first adjusting element with a first external thread is arranged in the guide channel. The first external thread can be screwed together with the first internal thread. The first adjusting element can be arranged in the guide channel such that, when the guide device is supported against a support surface of the recess, a force flow runs through the first adjusting element from the recess to the guide device.

BACKGROUND OF INVENTION

In turbines, in particular in large-diameter steam turbines, guide vane carriers are attached to the outer turbine casing. The guide vane carriers have stationary guide vanes that guide the internal flow in a predefined manner. In order to establish a predefined flow of a fluid in a turbine with precision, the guide vane carriers with the guide vanes must be oriented exactly relative to the turbine casing or to the rotor of the turbine. In that context, the guide vane carriers with the guide vanes must be arranged in a precisely predefined position with respect to the rotor blades of the rotor in order to provide the predefined flow of fluid and establish the predefined, function-specific play between the guide vanes and the rotor or between the rotor blades and the guide vane carriers.

It is known to position a guide vane carrier vertically and horizontally during the installation process by measuring a relative position of the guide vane carrier with respect to a rotor, and to correct this position using fitting elements. For position correction, the fitting elements are arranged between the guide vane carrier and a turbine casing in order to thus compensate for a previously measured deviation in the position of the guide vane carrier with respect to the rotor.

It is also known to orient guide vane carriers relative to a turbine casing using centering pins which are in the form of cap screws and are arranged in a parting joint flange of the guide vane carrier.

These apparatus for orienting a guide vane carrier relative to a turbine casing have the drawback that have to be removed for orienting the rotor and the guide vane carriers, and an orienting operation is therefore relatively onerous.

DE 10 2009 012 751 discloses a positioning system for orienting a guide vane carrier of a turbine relative to a casing of the turbine, which system has a positioning element with a first region and a second region, and an adjusting element. The positioning element can be secured in a form-fitting manner with the first region in a fitting opening in the guide vane carrier. The positioning element can be secured by means of the adjusting element with the second region in a receiving opening of the casing. The position of the positioning element in the receiving opening can be set, relative to the casing, by adjusting the adjusting element.

This apparatus for orienting a guide vane carrier relative to a turbine casing has the drawback that, for orienting an upper part of the casing of the turbine, use must be made of fitting pieces which are attached to a lower part of the casing by means of a screw connection. Orienting in this manner is particularly onerous and requires a large number of different fitting pieces.

SUMMARY OF INVENTION

Therefore, the present invention has an object of providing an apparatus for orienting a guide vane carrier relative to a turbine casing, obviating at least some of the above drawbacks.

This object is achieved according to the invention with an apparatus for orienting a guide vane carrier relative to a turbine casing as claimed, and with a method for orienting a guide vane carrier relative to a turbine casing as claimed. Other features and details of the invention can be found in the subclaims, the description and the drawings. Here, features and details which are described in conjunction with the apparatus according to the invention, are of course also applicable in conjunction with the method according to the invention and respectively vice versa, such that with regard to the disclosure relating to the individual aspects of the invention, reference is always made or can always be made reciprocally.

In a first aspect of the invention, the object is achieved with an apparatus for orienting a guide vane carrier relative to a turbine casing, having a guide device with a first region and a second region, wherein the first region is arranged in a recess of the guide vane carrier and the second region is arranged in a recess of the casing. The second region of the guide device has a guide channel with a first internal thread, wherein a first adjusting element with a first external thread is arranged in the guide channel. The first external thread can be screwed together with the first internal thread. The first adjusting element can be arranged in the guide channel such that, when the guide device is supported against a support surface of the recess, a force flow runs through the first adjusting element from the recess to the guide device. A second adjusting element with a second external thread is arranged in the guide channel, wherein the second external thread can be screwed together with the first internal thread. The second adjusting element can be arranged in the guide channel such that a force flow runs through the second adjusting element from an upper part of the casing to the guide device. The first adjusting element is secured by means of a securing device with the second adjusting element in the guide channel such that it cannot rotate relative to the guide channel.

The first adjusting element and the second adjusting element are advantageously cylindrical and have a length which ensures that, during the adjustment procedure, a sufficient number of thread turns are always in engagement with the first internal thread of the guide channel in order to transfer forces acting on the apparatus without damaging the thread. Moreover, the length of the first adjusting element must permit adjustment of the guide vane carrier relative to the casing, and the length of the second adjusting element must permit adjustment of the upper part relative to the guide vane carrier. The length of the adjusting elements is in particular limited by the fact that an adjusting element must not hamper adjustment of the respective other adjusting element. Accordingly, it is advantageous if, during adjustment of the second adjusting element, the adjusting elements are arranged spaced apart from one another in the guide channel.

The guide vane carrier can be raised or lowered relative to the casing by rotating the first adjusting element relative to the guide channel, thus permitting adjustment of the guide vane carrier relative to the casing. A bearing surface for the upper part of the casing can be raised or lowered by rotating the second adjusting element, thus permitting adjustment of the upper part relative to the guide vane carrier.

Within the context of the invention, it is advantageous for the first region to be arranged on the guide vane carrier, and for the second region to be arranged on the casing. Alternatively, it is possible for the first region to be arranged in a recess of the casing, and for the second region to be arranged in a recess of the guide vane carrier. In this alternative case, the adjustment procedure involves a relative movement between the guide device and the guide vane carrier.

The advantage of the invention lies in particular in the fact that one guide device makes it possible to carry out two adjustment processes, and the adjusting elements used for this purpose can be secured against shifting of the adjustment by means of a single securing device. Furthermore, the apparatus is simple and cost-effective to produce and requires, in comparison to conventional apparatus, a greatly reduced number of individual parts. This permits simple adjustment of guide vane carriers relative to the casing, and lowers both production and installation costs.

In one advantageous embodiment of the invention, an adjustment means is arranged between the first adjusting element and the support surface of the recess. The adjustment means is advantageously disk-shaped. A contact surface of the adjustment means, oriented toward the first adjusting element, advantageously corresponds essentially to a negative of the corresponding surface of the first adjustment means. The adjustment means advantageously has a semicircular cross-sectional area. This ensures an evenly distributed transfer of forces, even in the event of relative pivoting between the guide vane carrier and the casing.

Advantageously, a contact surface between the first adjusting element and the adjustment means is essentially spherical. In that context, it is advantageous if the adjustment means has a convex contact surface and the first adjusting element has a concave contact surface. Pairing a convex surface with a corresponding concave surface makes it possible to pivot the guide vane carrier about two axes relative to the casing.

In one embodiment, the apparatus has a first screw for attaching the guide device to the guide vane carrier. The first screw prevents the guide device coming loose from the recess when the turbine cools down.

According to another embodiment, the first region can be arranged with a form fit in the recess. A form fit reliably prevents relative movement between the guide device and the guide vane carrier, while a force-fitting connection, e.g. by means of seating phenomena, cannot always prevent such relative movements.

It is advantageous that the first adjusting element has a form-fitting section for the engagement of an installation tool that is guided through the guide channel. This permits adjustment of the guide vane carrier relative to the casing even in the installed state. In that context, the second adjusting element is advantageously not yet arranged in the guide channel. Alternatively, the second adjusting element can have a passage for a corresponding tool, such that the second adjusting element can be arranged in the guide channel even during adjustment by means of the first adjusting element.

Particularly, the securing device has a second screw for mutually bracing the first adjusting element and the second adjusting element in the guide channel. In that context, it is advantageous if the first adjusting element has a second internal thread for receiving a thread of the second screw and the second adjusting element has a bore for the passage of the second screw and a bearing surface against which a screw head of the second screw can press. This has the advantage that relative rotation between the adjusting elements and the guide channel can be prevented simply with just one securing means. This makes it possible to save both manufacturing and installation costs.

The object is also achieved, according to the invention, by means of a turbine casing with a guide vane carrier, wherein at least one apparatus according to the invention is arranged between the guide vane carrier and the casing.

Moreover, the object is achieved, according to the invention, with a method for orienting a guide vane carrier relative to a turbine casing, having the steps of: —arranging a first region of an adjustment apparatus in a recess of a guide vane carrier; —attaching the adjustment apparatus to the guide vane carrier by means of a first screw; —screwing a first adjusting element into a guide channel of a second region of the adjustment apparatus; —inserting an adjustment means into a recess of a casing of a turbine; —inserting the second region into the recess such that the adjustment means is arranged between a support surface of the recess and the first adjusting element; —orienting the guide vane carrier with the casing by rotating the first adjusting element relative to the guide channel; —screwing a second adjusting element into the guide channel; —orienting the guide vane carrier with an upper part of the casing by rotating the second adjusting element relative to the guide channel; and —bracing the first adjusting element with the second adjusting element by means of a second screw.

Advantageously, the adjustment apparatus has an apparatus according to the invention.

BRIEF DESCRIPTION OF THE DRAWINGS

An apparatus according to the invention for orienting a guide vane carrier relative to a turbine casing, the refinements thereof and their advantages will be explained in greater detail below with reference to a drawing. In the drawing:

FIG. 1 shows an embodiment of an apparatus according to the invention.

DETAILED DESCRIPTION OF INVENTION

FIG. 1 shows an apparatus 1 according to the invention in longitudinal section. The apparatus 1 has a guide device 4 with a first region 5 and a second region 6. The first region 5 is arranged with a form fit in a recess 7 of a receiving web of a guide vane carrier 2, and is attached thereto by means of a first screw 18.

The second region 6 is arranged in a recess 8 of a casing 3 and has a guide channel 9 with a continuous first internal thread 10. Alternatively, it is also possible for the first internal thread 10 to be interrupted, in particular in a central section.

A first adjusting element 11 with a first external thread 12 is arranged in a lower (in this representation) region of the guide channel 9 such that the first external thread 12 is in engagement with the first internal thread 10. The first adjusting element 11 has an essentially cylindrical main body which is cap-shaped on a bearing side. The bearing side is arranged on a part-spherical contact side of an adjustment means 17. The bearing side and the contact side are designed such that one is essentially the inverse of the other, and they are thus in contact with each other substantially over their entire surface area when paired. The adjustment means 17 is arranged between a support surface 13 of the recess 8 and the first adjusting element 11. The guide vane carrier 2 can be raised and lowered relative to the casing 3, and is thus adjustable, by rotating the first adjusting element 11 relative to the guide channel 9. This makes it possible to set a required play between the rotor and the guide vane carrier. It is therefore no longer necessary to dismantle a rotor, or to fit fitting elements.

A second adjusting element 14 with a second external thread 15 is arranged in an upper (in this representation) region of the guide channel 9 such that the second external thread 15 is in engagement with the first internal thread 10. The second adjusting element 14 has an essentially cylindrical main body and a bore 21 for the passage of a second screw 19, and a bearing surface 22 for a screw head 23. An upper part 16 of the casing 3 can be raised and lowered relative to the guide vane carrier 2, and is thus adjustable, by rotating the second adjusting element 14 relative to the guide channel 9. This makes it possible to set a defined play between the guide vane carrier 2 and the upper part 16. It is therefore no longer necessary to dismantle the rotor, or to fit fitting elements or to grind contact surfaces with respect to the upper part.

The apparatus 1 has a second screw 19 which is guided through the bore 21 of the second adjusting element 14, and is arranged with a thread section in a second internal thread 20 of the first adjusting element 11. By tightening the second screw 19, the screw head 23 bears against the bearing surface 22, such that the first adjusting element 11 is braced against the second adjusting element 14. Thus, the first adjusting element 11 and the second adjusting element 14 are prevented from rotating relative to the guide channel 9.

The invention claimed is:

1. An apparatus for orienting a guide vane carrier relative to a turbine casing, comprising:

a guide device comprising a first region and a second region, wherein the first region is arranged in a recess of the guide vane carrier and the second region is arranged in a recess of the turbine casing, wherein the second region of the guide device comprises a guide channel comprising a first internal thread, a first adjusting element comprising a first external thread arranged in the guide channel, wherein the first external thread is screwed together with the first internal thread, wherein the first adjusting element is arranged in the guide channel such that, when the guide device is supported against a support surface of the recess of the turbine casing, a force flow runs through the first adjusting element from the recess of the turbine casing to the guide device, and a second adjusting element comprising a second external thread arranged in the guide channel, wherein the second external thread is screwed together with the first internal thread, wherein the second adjusting element is arranged in the guide channel such that a force flow runs through the second adjusting element from an upper part of the turbine casing to the guide device, wherein the first adjusting element is secured by a securing device to the second adjusting element in the guide channel such that the first adjusting element and the second adjusting element cannot rotate relative to the guide channel, and wherein the securing device comprises a second screw for mutually bracing the first adjusting element and the second adjusting element in the guide channel, the second screw comprising a second-screw head and second-screw male threads, wherein the first adjusting element comprises a second internal thread for receiving the second-screw male threads.

2. The apparatus as claimed in claim 1, further comprising:

an adjustment means arranged between the first adjusting element and the support surface of the recess.

3. The apparatus as claimed in claim 2, wherein a contact surface between the first adjusting element and the adjustment means is essentially spherical.

4. The apparatus as claimed in claim 1, wherein the apparatus comprises a first screw for attaching the guide device to the guide vane carrier through a hole in the second region.

5. The apparatus as claimed in claim 1, wherein the first region can be arranged with a form fit in the recess of the guide vane carrier.

6. The apparatus as claimed in claim 5, wherein the form fit comprises an unthreaded fit.

7. The apparatus as claimed in claim 1, wherein the second adjusting element comprises a bore for passage of the second screw and a bearing surface against which the second-screw head can press, wherein the second screw is configured such that when turned in the second internal thread the second-screw male threads pull on the second internal thread while the second-screw head presses on the bearing surface which urges the first adjusting element and the second adjusting element toward each other, thereby locking the first adjusting element and the second adjusting element in respective positions on the first internal thread in the guide channel.

8. The turbine casing comprising the guide vane carrier, comprising:

at least one apparatus as claimed in claim 1 arranged between the guide vane carrier and the turbine casing.

9. A method for orienting a guide vane carrier relative to a turbine casing, comprising:

arranging a first region of an adjustment apparatus in a recess of the guide vane carrier;

attaching the adjustment apparatus to the guide vane carrier by a first screw;

screwing a first adjusting element into a guide channel of a second region of the adjustment apparatus;

inserting an adjustment means into a recess of a casing of a turbine;

inserting the second region into the recess of the casing of the turbine such that the adjustment means is arranged between a support surface of the recess and the first adjusting element;

orienting the guide vane carrier relative to a lower part of the casing by rotating the first adjusting element relative to the guide channel;

screwing a second adjusting element into the guide channel;

orienting an upper part of the casing relative to the guide vane carrier by rotating the second adjusting element relative to the guide channel; and bracing the first adjusting element with the second adjusting element by a second screw, the second screw comprising: male threads that screw into the first adjusting element; and a screw head.

10. The method as claimed in claim 9, comprising the adjustment apparatus comprising:

a guide device comprising the first region and the second region, wherein the first region is arranged in the recess of the guide vane carrier and the second region is arranged in the recess of the casing, wherein the second region of the guide device comprises the guide channel comprising a first internal thread, the first adjusting element comprising a first external thread arranged in the guide channel, wherein the first external thread is screwed together with the first internal thread, wherein the first adjusting element is arranged in the guide channel such that, when the guide device is supported against the support surface of the recess, a force flow runs through the first adjusting element from the recess to the guide device, and the second adjusting element comprising a second external thread arranged in the guide channel, wherein the second external thread is screwed together with the first internal thread, wherein the second adjusting element is arranged in the guide channel such that a force flow runs through the second adjusting element from the upper part of the casing to the guide device, and wherein the first adjusting element is secured by a securing device with the second adjusting element in the guide channel such that it cannot rotate relative to the guide channel.

* * * * *